US008143556B2

(12) United States Patent
Has et al.

(10) Patent No.: US 8,143,556 B2
(45) Date of Patent: Mar. 27, 2012

(54) CERAMIC HOB

(75) Inventors: Uwe Has, Unterneukirchen (DE); Peter Vetterl, Grabenstätt (DE); Monika Zeraschi, Traunreut (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1051 days.

(21) Appl. No.: 11/991,902

(22) PCT Filed: Sep. 7, 2006

(86) PCT No.: PCT/EP2006/066096

§ 371 (c)(1),
(2), (4) Date: Mar. 11, 2008

(87) PCT Pub. No.: WO2007/031458

PCT Pub. Date: Mar. 22, 2007

(65) Prior Publication Data

US 2009/0145891 A1 Jun. 11, 2009

(30) Foreign Application Priority Data

Sep. 14, 2005 (DE) ..... 10 2005 043 917

(51) Int. Cl.
*H05B 3/68* (2006.01)
*H05B 1/02* (2006.01)

(52) U.S. Cl. ..... 219/448.13; 219/490

(58) Field of Classification Search ..... 219/446.1, 219/447.1, 448.11, 448.12, 448.14, 460.1, 219/490, 494

See application file for complete search history.

(56) References Cited

U.S. PATENT DOCUMENTS

| | | | | |
|---|---|---|---|---|
| 4,447,710 | A * | 5/1984 | McWilliams | 219/448.14 |
| 6,753,509 | B2 * | 6/2004 | Gratz et al. | 219/448.17 |
| 6,967,314 | B2 * | 11/2005 | Sauter et al. | 219/483 |
| 2004/0007566 | A1 | 1/2004 | Staebler et al. | |
| 2004/0200828 | A1 | 10/2004 | Becker et al. | |

FOREIGN PATENT DOCUMENTS

| | | |
|---|---|---|
| DE | 197 20 576 | 11/1998 |
| DE | 199 03 300 | 8/1999 |
| DE | 199 18 290 | 1/2001 |
| DE | 10 2004 013 533 | 7/2005 |
| EP | 1 231 530 | 8/2002 |

OTHER PUBLICATIONS

International Search Report PCT/EP2006/066096.

* cited by examiner

*Primary Examiner* — Sang Paik
(74) *Attorney, Agent, or Firm* — James E. Howard; Andre Pallapies

(57) ABSTRACT

A ceramic hob for a cooking appliance provided with a control device for controlling and/or adjusting a real temperature value on at least one part of a cooking plate arranged in a container for cooking by means of an associated heating device. The inventive ceramic hob comprises at least one temperature sensor for determining the real temperature value of a heatable part and at least one control element used for setting said temperature to a desired value, wherein a desired temperature value of the heatable part is assigned thereto. According to said invention several desired values can be assigned to one control element.

20 Claims, 2 Drawing Sheets

CERAMIC HOB

Figure 1:
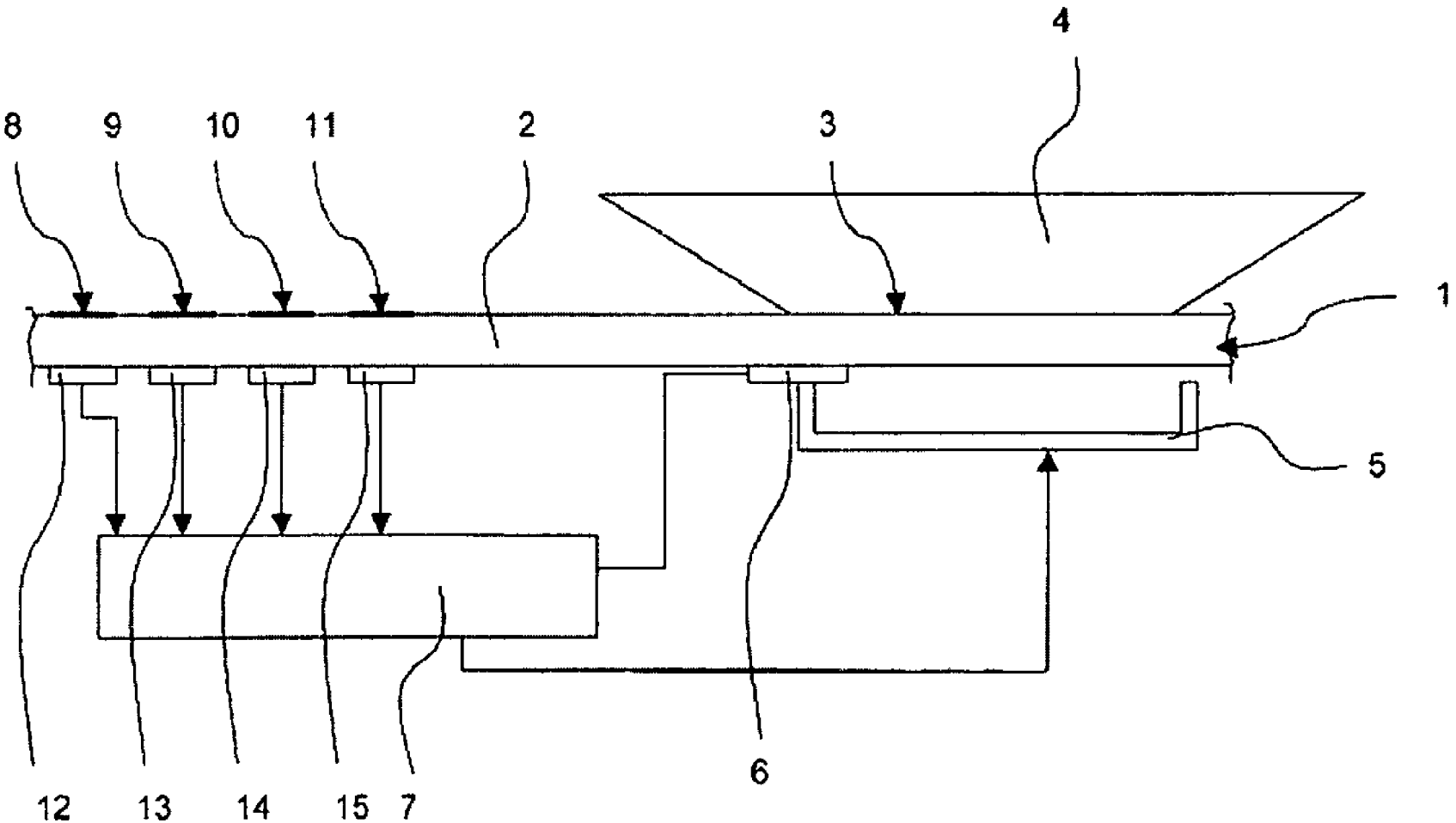

The present invention relates to a cooktop, with a control device for controlling and/or regulating an actual temperature value of an item of cookware heated by means of an assigned heating device, with at least one temperature sensor to detect the respective actual temperature value of the item of cookware and with at least one control element for predetermining a setpoint temperature to which a first setpoint temperature value stored in the controller is assigned.

This type of cooktop of a cooking appliance is known from the prior art. The known cooktop has a control device, with which an actual temperature value is able to be set at the various heated areas of the cooking zone as a function of for example a setpoint temperature value able to be predetermined by an operator. The control device is also referred to as a baking sensor or cooking sensor system in the known cooktop. This sensor system makes it possible to monitor and control the temperature at the heated areas of the cooking zone for cooking food.

Usually the cooking zone consists of glass ceramic. The control unit features at least one temperature probe or sensor with which the actual temperature value can be detected at the respective heated area in each case. With the known cooktop the temperature probe is usually arranged below the cooking zone and is assigned to the heated areas.

The control device can activate a heating device assigned to the heated area with the actual temperature value detected in each case as a function of a predetermined setpoint temperature value. Since the temperature probe is not assigned directly to the bottom of the cookware, in the control of the actual temperature value an algorithm is used which determines a possible temperature difference between the temperature at the bottom of the cookware and the temperature detected by the temperature probe. The algorithm is stored in the control device so that the temperature difference determined can be taken into consideration in the control operation. This algorithm has been determined during technological trials in cookery in which so-called system cookware, such as for example a system pan or a system pot, has been used.

With the known cooktop a number of controls can be provided to each of which a specific cooking level, such as minimum, medium and maximum for example, is assigned. Each cooking level is assigned a specific setpoint temperature value which has also been determined in cookery trials using system cooking pots. In such cases the requirements of a healthy preparation of food as well as the average requirements of the users have been taken into account. By actuating one of the controls the operator can select a specific cooking level in order to execute the cooking process in accordance with the selected cooking level with the assigned setpoint temperature value.

When other cooking pots not linked into the system are used, because of heat-conducting properties and shapes of the cooking pots not linked into the system, a cooking process can under some circumstances not be executed satisfactorily for a selected cooking level.

The object of the present invention is thus to propose a cooktop of the type mentioned at the start with which a cooking process is able to be executed satisfactorily with any type of cooking pot and specific requirements of the operator can also be taken into consideration.

In accordance with the invention this object is achieved by the features of claim 1. Advantageous developments emerge especially from the subclaims.

Inventively, for a cooktop with a cooking zone for cookware, a control device for controlling an actual temperature value at each heated area of the cooking zone can be provided. A heating device assigned to a heated area in each case can be activated with the control device so that a desired cooking of food in an item of cookware is made possible. Furthermore the inventive cooktop can feature a temperature probe for detecting the actual temperature value for each heated area in order to set the actual temperature value as a function of a setpoint value predetermined by the operator. A number of control elements can be provided for pre-determining the setpoint value. Each control element can be assigned a specific setpoint temperature value which corresponds to a specific cooking level.

Inventively a number of predetermined setpoint temperature values can be assigned to each control element. In this way an improved or individual temperature regulation can be undertaken at the heated areas with the inventive cooktop regardless of whether system cookware such as system pans and system pot for example which were supplied with the cooktop are being used by the operator.

In the inventive cooktop any given number of control elements for temperature regulation can be used to which a number of predetermined setpoint temperature values are able to be assigned in each case. An operator can thus select the setpoint temperature values depending on the desired cooking level and depending on the type as well as the characteristics of the cookware used and finally assign them to one or more control elements. Consequently a cooking process to be undertaken can be influenced individually by the operator or can be changed to achieve a desired cooking result.

Within the framework of an advantageous embodiment of the present invention there can be provision for example for three control elements to be assigned to a respective cooking level. The setpoint temperature value assigned to a control element in each case can be modified in accordance with the invention jointly or simultaneously with the other control elements by a predefined temperature value. The control elements can for example be assigned to the cooking levels minimum, medium and maximum, so that an operator, by selecting a specific cooking level, can achieve a desired cooking result, when roasting meat for example. Should a desired cooking result not be achieved when a given non-system-linked item of cookware is used, the predetermined setpoint temperature value assigned in each case can be adapted by simultaneously changing the setpoint temperature value at all control elements for example. Thus an adaptation of the predetermined setpoint temperature value can be implemented in the simplest manner so that each cooking level can be adapted by the operator to specific influencing values such as the material properties of the cookware used or similar for example.

Preferably this modification of the assigned setpoint temperature can be made possible by an adjustment element assigned to all the control elements. By simply pressing it, turning or otherwise actuating the adjustment element, the desired modification to the predetermined setpoint temperature value of each operating element can be undertaken.

The modification of the desired temperature value assigned in each case can be undertaken in stages for example. It is possible for example for a number, e.g. five, temperature levels to be used which are each assigned as respective setpoint temperature value to the control elements. The number and the relevant assigned temperature of the temperatures levels can be selected as required.

In an advantageous development a first control element can be assigned to the second temperature level in its basic setting. By activating the first control element a minimum cooking level can be selected. A second control element can be assigned to the third temperature level for example. When the second control element is actuated a medium cooking level can be implemented. Finally, by actuating a third control element, a maximum cooking level can be selected, which is reached by the fourth temperature level.

With this selected basic setting of the inventive cooktop an increase in the setpoint temperature values can occur by the individual control elements each being assigned a temperature level increased by one level. A reduction of the setpoint temperature values can be achieved with the so-called basic setting by the setpoint temperature values of the individual control elements being assigned in each case a temperature level reduced by one level. Other assignment options for the inventive cooktop are also conceivable.

A further possible embodiment of the present invention can also make provision for the assigned setpoint temperature value of each control element to be able to be adjusted for each control element. This type of modification of the setpoint temperature values can be advantageous especially for skilled users, since this option allows an individual temperature regulation for the desired cooking processes. It is also conceivable that both a joint adjustment and also a separate individual adjustment of the setpoint temperature values is possible with the inventive cooktop.

There can for example be provision made in the separate adjustment of the assigned setpoint temperature value of a control element for each control element to be assigned a separate own adjusting element to increase or decrease the setpoint temperature value. It is also possible for a menu-controlled adjustment to be used in which a control element or an adjusting element is able to be assigned a number of functions.

As well as the proposed level-by-level adjustment, according to a further development it is also conceivable for a continuous adjustment of the assigned setpoint temperature value to be made possible for the inventive cooktop.

Furthermore at least one memory key or similar could be provided with which an individual adjustment of the assigned setpoint temperature values of the user can be stored which differs from the basic setting. Possibly a number of individual settings, made by different users for example, can also be stored.

A touch panel with wireless receiver section can preferably be provided as control element or adjusting element, which is electrically connected with the control device. Other elements can however also be used such as a rotary knob or similar for example which is preferably able to be withdrawn into the cooking zone when not being used.

Figure 2:
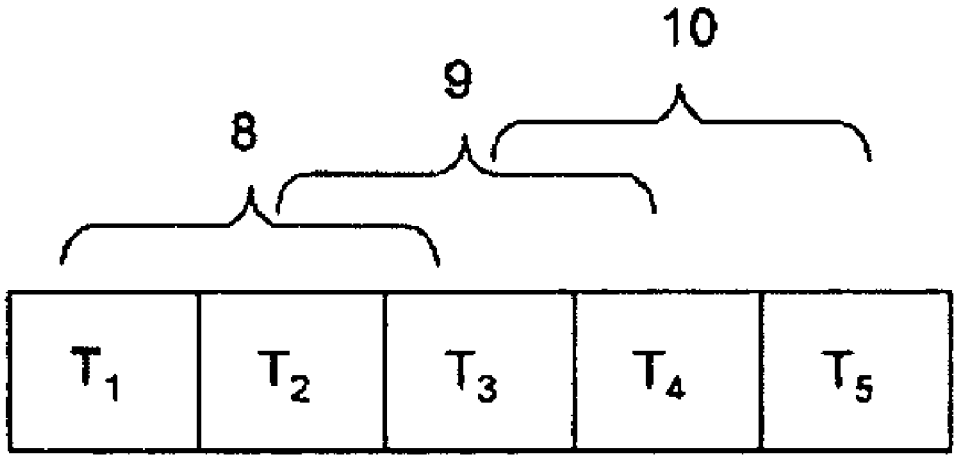

The present invention will be explained below in greater detail with reference to the drawing. The figures show:

FIG. 1 a schematic part view from the side of a possible embodiment of an inventive cooktop; and FIG. 2 a schematic view of possible temperature levels as assignable setpoint temperature values.

FIG. 1 represents a part side view of a possible embodiment of an inventive cooktop 1 with a cooking zone 2 made of glass ceramic. The cooking zone 2 features a number of heatable areas 3 with a heated area 3 being indicated in FIG. 1 by way of example on which an item of cookware 4 is arranged.

Arranged below the cooking zone 2 are the heated area 3, a heating device 5 and a temperature probe 6. The actual temperature value at the heated area 3 can be detected with the temperature probe 6. The inventive cooktop 1 has a control device 7 for controlling and/or regulating the actual temperature value, which controls the heating device 5 for adjusting a specific setpoint temperature value. Above and beyond this, in the embodiment shown, three control elements 8, 9, 10 are provided for predetermination of a specific cooking level by the operator.

A minimum cooking level (minimum) can be selected with the first control element 8. A lower setpoint temperature value is therefore assigned to the first control element 8. A medium cooking level (medium) can be selected by the second control element 9. This means that the second control element 9 is assigned a medium setpoint temperature value. Finally, by actuating at the third control element 10, a maximum cooking level (maximum) can be selected. Consequently the third control element 10 is assigned a higher setpoint temperature value.

To improve the predetermination of the setpoint temperature values for the individual control elements 8, 9, 10 there is provision in the invention for each individual control element 8, 9, 10 to be able to be assigned a number of predetermined setpoint temperature values. With the embodiment shown by way of example of the inventive cooktop 1 an adjustment element 11 is provided for this purpose with which an increase or reduction of the setpoint temperature value is enabled for all control elements 8, 9, 10.

With the inventive cooktop the three control elements 8, 9, 10 and the adjustment element 11 are embodied as touch panels integrated into the cooking zone 2 which are connected wirelessly to an assigned receiver section 12, 13, 14, 15 electrically to the control device 7. By touching the touch panels of the control elements 8, 9, 10 one of the cooking levels can be selected. If the operator wishes to make an adjustment to the assigned setpoint temperature values, with an activated cooking level, by touching the adjustment element 11 he can increase the setpoint temperature value assigned to this cooking level. It is also possible that the operator has not activated any cooking level in advance and then, by actuating at the control element 11, changes the setpoint temperature value for all cooking levels.

FIG. 2 shows a schematic, possibly level-by-level assignment variant of the setpoint temperature values of the individual control elements 8, 9, 10 as a schematic diagram. In this case it is assumed that five different temperature levels T1, T2, T3, T4, T5 are able to be selected. For a possible basic setting of the inventive cooktop the first control element 8 is assigned the temperature T2 of 120° C. for example. The second control element 9 is assigned the temperature stage T3 in the basic setting with a temperature of around 130° C. While the third control element 10 is assigned the temperature stage T4 with a temperature of for example 140° C. The said temperatures are only given as examples so that the temperature levels can also be assigned to any other given temperatures.

With a joint reduction of the assigned setpoint temperature values each control element 8, 9, 10 can be assigned a temperature level reduced by one level. By contrast, for increasing the setpoint temperature values each control element 8, 9, 10 can be assigned a temperature stage increased by one level in each case This is indicated in FIG. 2 by the pointed brackets which each indicate temperature levels able to be assigned to a control element 8, 9, 10. It is also possible for any other given assignment to be provided.

REFERENCE SYMBOLS

1 Cooktop
2 Cooking zone
3 Heated area
4 Cookware

5 Heating device
6 Temperature probe
7 Control device
8 First control element
9 Second control element
10 Third control element
11 Adjusting element
12 Receive section
13 Receive section
14 Receive section
15 Receive section

The invention claimed is:

1. A cooktop comprising:

a heating device;

a control device for controlling an actual temperature value of an item of cookware heated by the heating device;

at least one temperature probe for detecting the actual temperature value of the item of cookware;

a first user selectable control element that selects a first setpoint temperature value stored in the control device from a plurality of setpoint temperature values stored in the control device, the first setpoint temperature value being associated with a first setpoint indicator that indicates the selection of the first setpoint temperature value; and means operatively associated with the control device for directing the first control element to store a modified first setpoint temperature value that is different from the first setpoint temperature value, and associating the modified first setpoint temperature value with the first set point indicator while the first setpoint indicator indicates the selection of the first setpoint temperature value.

2. The cooktop according to claim 1, further comprising means for user-side actuation of the control device for assigning at least one of the first setpoint temperature value and the modified first setpoint temperature value to the control element.

3. The cooktop according to claim 1 wherein the modified first setpoint temperature value is different by a common temperature difference of about 10 Kelvin from the first setpoint temperature value.

4. The cooktop according to claim 1, further comprising a second user selectable control element that selects a second setpoint temperature value stored in the control device from the plurality of setpoint temperature values stored in the control device, the second setpoint temperature value being associated with a second setpoint indicator that indicates the selection of the second setpoint temperature value; and an adjustment element assigned jointly to the first control element and the second control element for simultaneously modifying the first and second setpoint temperature values.

5. The cooktop according to claim 4, further comprising means for level-by-level adjustment of the first and second setpoint temperature values.

6. The cooktop according to claim 1, further comprising means for storing a series of temperature values in the control device.

7. The cooktop according to claim 5, wherein the first setpoint temperature value and the modified first setpoint temperature value includes at least two temperature values from a series of temperature values which exhibit the smallest temperature difference from each other.

8. The cooktop according to claim 1, further comprising a plurality of user selectable control elements and means for adjusting the assigned setpoint temperature value of each control element.

9. The cooktop according to claim 8, wherein each control element is assigned an adjustment element for modifying its first setpoint temperature value.

10. The cooktop according to claim 1, further comprising means for continuously setting the assigned setpoint temperature value.

11. The cooktop according to claim 1, further comprising at least one user-accessible memory unit for storing an individual setting of assigned setpoint temperature values.

12. A cooktop comprising:

a heating device;

a control device for controlling an actual temperature value of an item of cookware heated by the heating device;

at least one temperature probe for detecting the actual temperature value of the item of cookware;

a first user selectable control element that selects a first setpoint temperature value stored in the control device from a plurality of setpoint temperature values stored in the control device, the first setpoint temperature value being associated with a first setpoint indicator that indicates the selection of the first setpoint temperature value;

a second user selectable control element that selects a second setpoint temperature value stored in the control device from the plurality of setpoint temperature values stored in the control device, the second setpoint temperature value being associated with a second setpoint indicator that indicates the selection of the second setpoint temperature value; and an adjustment element assigned jointly to the first control element and the second control element that simultaneously modifies the first setpoint temperature value to a modified first setpoint temperature value that is different from the first setpoint temperature value, and modifies the second setpoint temperature value to a modified second setpoint temperature value that is different from the second setpoint temperature value, wherein the first setpoint indicator and the second setpoint indicator remain unchanged after the modifying of the first and second setpoint temperature values.

13. The cooktop according to claim 12, wherein the difference between the modified first setpoint temperature value and the first setpoint temperature value is a predetermined number of degrees Kelvin, and the difference between the modified second setpoint temperature value and the second setpoint temperature value is the predetermined number of degrees Kelvin.

14. The cooktop according to claim 13, wherein the predetermined number of degrees Kelvin is selected from one of a plurality of temperature differences.

15. The cooktop according to claim 12, wherein the adjustment element is user selectable.

16. The cooktop according to claim 12, further comprising a storage device that stores a series of temperature values in the control device.

17. The cooktop according to claim 12, wherein the first setpoint indicator indicates a low temperature setting, and the second setpoint indicator indicates a high temperature setting.

18. The cooktop according to claim 12, further comprising a third user selectable control element that selects a third setpoint temperature value stored in the control device from the plurality of setpoint temperature values stored in the control device, the third setpoint temperature value being associated with a third setpoint indicator that indicates the selection of the third setpoint temperature value, wherein the adjustment element modifies the third setpoint temperature value to a modified third setpoint temperature value that is different from the third setpoint temperature value, the third setpoint temperature value is modified simultaneously with the modification of the first and second setpoint temperature values, and the third setpoint indicator remains unchanged after the modifying of the third setpoint temperature value.

19. The cooktop according to claim 18, wherein the first setpoint indicator indicates a low temperature setting, the second setpoint indicator indicates a medium temperature setting, and the third setpoint indicator indicates a high temperature setting.

20. The cooktop according to claim 19, wherein the difference between the modified first setpoint temperature value and the first setpoint temperature value is a predetermined number of degrees Kelvin, the difference between the modified second setpoint temperature value and the second setpoint temperature value is the predetermined number of degrees Kelvin, and the difference between the modified third setpoint temperature value and the third setpoint temperature value is the predetermined number of degrees Kelvin.

* * * * *